US008092868B2

(12) United States Patent
Fujiwara

(10) Patent No.: US 8,092,868 B2
(45) Date of Patent: Jan. 10, 2012

(54) DIE COATING APPARATUS, DIE COATING METHOD, AND ADHESIVE SHEET AND FOAMED SHEET

(75) Inventor: Shuzo Fujiwara, Ibaraki (JP)

(73) Assignee: Nitto Denko Corporation, Osaka (JP)

( * ) Notice: Subject to any disclaimer, the term of this patent is extended or adjusted under 35 U.S.C. 154(b) by 455 days.

(21) Appl. No.: 12/421,965

(22) Filed: Apr. 10, 2009

(65) Prior Publication Data

US 2009/0263626 A1 Oct. 22, 2009

(30) Foreign Application Priority Data

Apr. 21, 2008 (JP) ..... 2008-110111

(51) Int. Cl.
*B05D 7/00* (2006.01)

(52) U.S. Cl. ..... 427/402; 427/355; 427/356; 427/359; 427/428.01; 427/428.02

(58) Field of Classification Search ..... 427/402, 427/355, 356, 359, 428.01, 428.02
See application file for complete search history.

(56) References Cited

FOREIGN PATENT DOCUMENTS

| | | | |
|---|---|---|---|
| JP | 2000-167461 | A | 6/2000 |
| JP | 2002-136909 | A | 5/2002 |
| JP | 2002-153797 | A | 5/2002 |
| JP | 2003-053232 | A | 2/2003 |
| JP | 2007-075798 | A | 3/2007 |

OTHER PUBLICATIONS

English abstract of the Japanese Patent No. Jp 2007075798 A dated Mar. 29, 2007.*

* cited by examiner

*Primary Examiner* — Eisa Elhilo
(74) *Attorney, Agent, or Firm* — Sughrue Mion, PLLC

(57) ABSTRACT

The present invention provides a die coating apparatus, which includes a die including an upstream-side bar and a downstream side-bar aligned with each other along a direction of transportation of a band-shaped support continuously transported by a backup roll so as to form a pocket for storing a coating solution and a slit serving as a feed-out path of the coating solution, the slit having an outlet for feeding out the coating solution stored in the pocket of the die therefrom to thereby coat the coating solution on the band-shaped support, in which the downstream-side bar has a lip having a divergent cross-sectional shape continuous in the direction of a width of the downstream-side bar, and an inclination angle θ of a side end part on the most downstream side of the lip of the downstream-side bar is within the range of 20° to 80°.

10 Claims, 5 Drawing Sheets

DIE COATING APPARATUS, DIE COATING METHOD, AND ADHESIVE SHEET AND FOAMED SHEET

FIELD OF THE INVENTION

The present invention relates to a coating apparatus and a coating method for smoothly coating an adhesive on a band-shaped support, and an adhesive sheet and a foamed sheet containing bubbles, which are manufactured by the coating method.

BACKGROUND OF THE INVENTION

As an apparatus for smoothly coating an adhesive on a band-shaped support, there has been widely available a die coating apparatus by which a coating solution including a resin solution and the like stored in a pocket 21 of a die 8 is fed out of an outlet of a slit 4 onto a band-shaped support 5 continuously transported by a backup roll 6 as shown in FIG. 8. For a common die coating apparatus, there is used a die in which the inclination angle θ of a side end part of a lip of a downstream-side bar 101*a* is an acute angle or a right angle as shown in FIG. 6.

In order to uniformly coat a coating solution on a band-shaped support continuously transported by a backup roll with the die coating apparatus, it is important to coat the coating solution while causing crosslinking with stability, with the film thickness of the coating solution set constant from the lip tip part to the band-shaped support. Under such circumstances therebehind, in Patent Document 1, the height of the lip of the upstream-side bar is set larger than that of the downstream-side bar of the die, so that a high-concentration high-viscosity non-Newtonian dispersion is uniformly coated. Whereas, in Patent Document 2, the length of the base of the lip of the upstream-side bar of the die is specified to be 20 μm to 100 μm, and the angle formed between the front wall surface of the lip of the upstream-side bar and the slit is set at 45° or less. Thus, the step unevenness of the coating solution is suppressed.

In Patent Document 3, in a die coating apparatus for coating a plurality of coating solutions in a multilayer form, the length of the base of each lip of the die is set long from the downstream side to the upstream side of the direction of transportation of the band-shaped support. Whereas, in Patent Document 4, in a die coating apparatus for coating a plurality of coating solutions in a multilayer form, the gap between each lip and the band-shaped support is set at a value larger than a value three times the length of the base of each lip, and smaller than a value fifty times the length thereof, whereby the step unevenness of the coating solution is inhibited.

However, even when coating is carried out with the die coating apparatus using the die having each lip shape according to Patent Documents 1 to 4, skinning occurs at the end of the lip. Thus, unfavorably, defects such as lateral steps or stripes occur on the coated surface due to the skinning.

Whereas, in Patent Document 5, there is shown a die for extrusion in which the incline angles θ of the side end parts of lips of the upstream-side bar and the downstream-side bar of the die are an acute angle, and the shapes of the lips are symmetrical with respect to the slit. Owing to such a lip shape, the coating solution can be prevented from being left at the tip of the die, whereby a coating layer having smooth surface can be formed. However, even in the case where the die having the lip shape described in Patent Document 5 is used for coating, when the wet layer thickness of the coating solution becomes as large as 300 μm to 3000 μm, the gap between the lip and the band-shaped support is required to be increased larger than the wet layer thickness. Thus, in such a case, unfavorably, the coated surface becomes less likely to be stabilized.

In view of the above-described situation, it has been demanded for a long time to provide a solution which enables preventing skinning by the coating solution so as to form a coating layer having smooth surface as long as possible, and stably produces a resin sheet or the like having favorable surface conditions even when the thickness of the wet layer is as relatively large as 300 μm to 3000 μm.

Patent Document 1: JP-A-2003-53232
Patent Document 2: JP-A-2007-75798
Patent Document 3: JP-A-2002-136909
Patent Document 4: JP-A-2002-153797
Patent Document 5: JP-A-2000-167461

SUMMARY OF THE INVENTION

It is an object of the present invention to provide a die coating apparatus and a die coating method capable of stably keeping the coated surface at the time of feeding out a coating solution stored in a pocket of a die from a slit onto a band-shaped support transported by a backup roll to thereby coat the coating solution onto the support, and an adhesive sheet and a foamed sheet manufactured by the die coating method.

In order to achieve the foregoing object, the present invention provides, as item 1, a die coating apparatus, which includes a die including an upstream-side bar and a downstream side-bar aligned with each other along a direction of transportation of a band-shaped support continuously transported by a backup roll so as to form a pocket for storing a coating solution and a slit serving as a feed-out path of the coating solution, the slit having an outlet for feeding out the coating solution stored in the pocket of the die therefrom to thereby coat the coating solution on the band-shaped support, in which the downstream-side bar has a lip having a divergent cross-sectional shape continuous in the direction of a width of the downstream-side bar, and an inclination angle θ of a side end part on the most downstream side of the lip of the downstream-side bar is within the range of 20° to 80°.

It is preferable that the inclination angle θ of the side end part of the most downstream side of the lip of the downstream-side bar is set to be an acute angle. In view of also the workability and the strength of the metal, the angle θ is preferably with in the range of 20° to 80°, and more preferably within the range of 45° to 80°. In the case where the angle θ is within the range, even when the wettability of the coating solution and the material of the die is good, the liquid interface crosslinking from the lip tip part of the downstream-side bar to the band-shaped support becomes less likely to move from the tip part of the lip. For this reason, defects such as lateral steps and stripes caused on the coated surface become less likely to occur, which allows stabilization of the coated surface.

The present invention also provides, as item 2, the die coating apparatus according to item 1 above, which further includes another one or more bars sandwiched between the upstream-side bar and the downstream-side bar of the die so as to form two or more pockets for storing two or more kinds of coating solutions and two or more slits serving as feed-out paths of the two or more kinds of the coating solutions, whereby a multilayered wet layer of the coating solutions is formed on the band-shaped support.

By sandwiching another one or more bars between the upstream-side bar and the downstream-side bar, multilayer coating by a large number of kinds of coating solutions can be carried out. Further, even in the case of carrying out such multilayer coating, when the inclination angle θ of the side end part on the most downstream side of the lip of the downstream-side bar falls within the range of 20° to 80°, the liquid interface becomes less likely to move from the tip part of the lip, which enables stabilization of the coated surface.

The present invention furthermore provides, as item 3, the die coating apparatus according to item 1 or 2 above, in which a height of a tip part of a lip of the upstream-side bar is larger than a height of a tip part of the lip of the downstream-side bar by 0.3 mm to 3 mm.

It is preferable that the tip part of the lip of the upstream-side bar is situated at a position higher than the tip part of the lip of the downstream-side bar across the coating solution feed-out slit, and that the difference in level is 0.3 mm to 3 mm. The numerical value somewhat varies according to the viscosity and the surface tension of the coating solution. However, the numerical value is generally 30% to 130%, and further preferably 50% to 100% relative to the coating layer thickness. In the case where the difference in level falls within this numerical value range, even when the distance between the tip part of the lip of the downstream-side bar and the backup roll is large, it becomes possible to carry out coating while stably keeping the coated surface.

The present invention furthermore provides, as item 4, the die coating apparatus according item 3 above, in which at least one layer of the multilayered wet layer coated on the band-shaped support has a thickness of 300 μm to 3000 μm.

By employing the die coating apparatus having the lip shape as shown in item 3 above, it is possible to complete coating at one step by simultaneous multilayer coating even when coating is desired to be carried out with the thickness of at least one layer of the wet layer to be coated on the band-shaped support being 300 μm to 3000 μm.

The present invention furthermore provides, as item 5, a die coating method, which includes feeding out a coating solution stored in a pocket of a die in which an upstream-side bar and a downstream-side bar are aligned with each other along a direction of transportation of a band-shaped support continuously transported by a backup roll so as to form the pocket for storing the coating solution and a slit serving as a feed-out path of the coating solution, from an outlet of the slit to thereby coat the coating solution on the band-shaped support, in which the downstream-side bar has a lip having a divergent cross-sectional shape continuous in the direction of a width of the downstream-side bar, and an inclination angle θ of a side end part on the most downstream side of the lip of the downstream-side bar is within the range of 20° to 80°.

The present invention furthermore provides, as item 6, the die coating method according to item 5 above, in which another one or more bars are sandwiched between the upstream-side bar and the downstream-side bar of the die so as to form two or more pockets for storing two or more kinds of coating solutions and two or more slits serving as feed-out paths of the two or more kinds of coating solutions, whereby a multilayered wet layer of the coating solutions is formed on the band-shaped support.

The present invention furthermore provides, as item 7, the die coating method according to item 5 or 6 above, in which a height of a tip part of a lip of the upstream-side bar is larger than a height of a tip part of the lip of the downstream-side bar by 0.3 mm to 3 mm.

The present invention furthermore provides, as item 8, the die coating method according to item 7 above, in which at least one layer of the multilayered wet layer coated on the band-shaped support has a thickness of 300 μm to 3000 μm.

The present invention furthermore provides, as item 9, an adhesive sheet which is manufactured by the die coating method according to any one of items 5 to 8 above.

The present invention furthermore provides, as item 10, a foamed sheet containing bubbles, which is manufactured by the die coating method according to any one of items 5 to 8 above.

Figure 1:
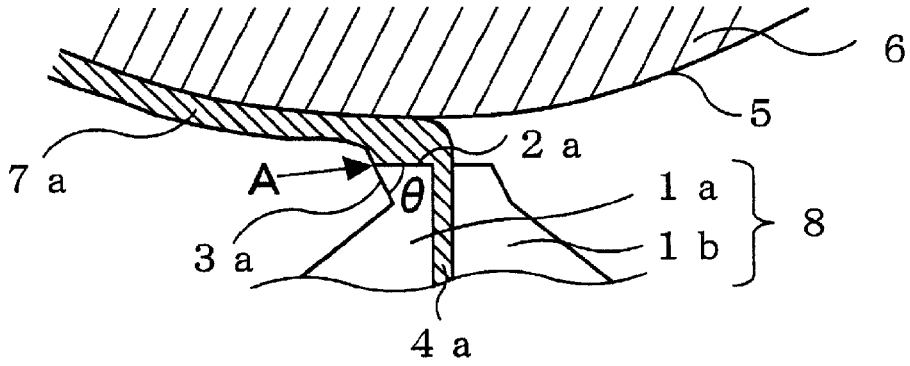
FIG. 1 shows a shape of a tip part of a lip of a die coating apparatus proposed in the present invention.

| Description of reference numerals and signs | |
|---|---|
| 1a | upstream-side bar |
| 1b | downstream-side bar |
| 2a | base of lip of downstream-side bar |
| 3a | outer wall surface of lip of downstream-side bar |
| 4a | slit |
| 5 | band-shaped support |
| 6 | backup roll |
| 7a | coating solution |
| 8 | die |
| A | tip part of lip |
| θ | inclination angle of side end part of lip |

DETAILED DESCRIPTION OF THE INVENTION

Below, embodiments for carrying out the present invention will be described by reference to the accompanying drawings.

FIG. 1 is one embodiment of a cross sectional view of a tip of a die for use in the die coating apparatus and the die coating method of the invention. As shown in FIG. 1, in a die 8 for use in the invention, a downstream-side bar 1*a* and an upstream-side bar 1*b* face each other with a given gap therebetween along the direction of transportation of a band-shaped support 5 continuously transported by a backup roll 6, thereby forming a slit 4*a*.

Below, respective parts forming the die 8 for use in the die coating apparatus in this embodiment will be described. The portions of the downstream-side bar 1*a* and the upstream-side bar 1*b* forming the die 8 in the vicinity of the coating solution discharge port are referred to as lips. The lip of the downstream-side bar 1*a* of the die 8 has a divergent cross-sectional shape toward the backup roll 6. Namely, in the invention, the angle θ formed between the base 2*a* and the outer wall surface 3*a* of the lip of the downstream-side bar 1*a* is set to be an acute angle. Incidentally, the angle θ is preferably 20° to 80°, and further preferably 45° to 80°. When coating is carried out using the die 8 having the downstream-side bar 1*a* having such a lip shape, the coating solution 7*a* discharged from the outlet of the slit 4*a* becomes less likely to be deposited on the outer wall surface 3*a* of the lip beyond the tip part A of the lip of the downstream-side bar 1*a*. Accordingly, occurrence of skinning due to solvent evaporation after deposition of the coating solution on the outer wall surface of the lip can be prevented, and coating thus can be stably carried out without causing defects such as lateral steps or stripes on the coated surface.

The downstream-side bar 1*a* is a bar situated on the most downstream side along the direction of transportation of the band-shaped support 5 continuously transported by the backup roll 6, of the bars forming the die 8. Incidentally, the base 2*a* of the lip of the downstream-side bar 1*a* denotes the base of the lip of the downstream-side bar 1*a* which faces the backup roll 6. Whereas, the outer wall surface 3*a* of the lip of the downstream-side bar 1*a* denotes the surface inclined from the base 2*a* of the lip of the downstream-side bar 1*a* with the tip part A of the lip as the boundary. Herein, the angle θ formed between the base 2*a* and the outer wall surface 3*a* of the lip of the downstream-side bar 1*a* is expressed as the inclined angle of the side end part on the most downstream side of the lip of the downstream-side bar 1*a*.

The upstream-side bar 1*b* is a bar situated on the most upstream side along the direction of transportation of the band-shaped support 5 continuously transported by the backup roll 6, of the bars forming the die 8.

The die, and the bars forming the die can be formed of an appropriate material such as a metal or plastic. Furthermore, the width thereof can also be set at an appropriate length according to the objective casting width of the coating solution, or the like. Furthermore, the cross sectional form except for the lips of the die is also an arbitrary form.

The slit 4*a* formed inside the die by the bars forming the die is a feed-out path for feeding out the coating solution 7*a* onto the band-shaped support 5. The width of the slit 4*a* can be appropriately determined according to the objective coating thickness of the coating solution 7*a*. The width is generally 3 mm or less, and further preferably 0.1 mm to 2 mm.

The backup roll 6 is for continuously transporting the band-shaped support 5, and the continuous transportation speed can be adjusted by the rotational speed of the backup roll 6.

As the band-shaped support 5, there is used a member which is a belt-like member or a plate-like member such as an endless belt, other than a drum, and can successively and continuously receive the coating solution 7*a* discharged and coated thereon, and can support the developed layer and can keep the layer in a sheet form.

The coating solution 7*a* to be used is preferably an adhesive, a foam-like liquid containing bubbles, or the like, but has no particular restriction on the type. In view of the smoothness of the coated surface, and prevention of die deformation due to the internal pressure of the die, the viscosity of the coating solution is preferably 0.1 Pa·s to 100 Pa·s, more preferably 1 Pa·s to 80 Pa·s, and further preferably 5 Pa·s to 50 Pa·s.

Figure 8:
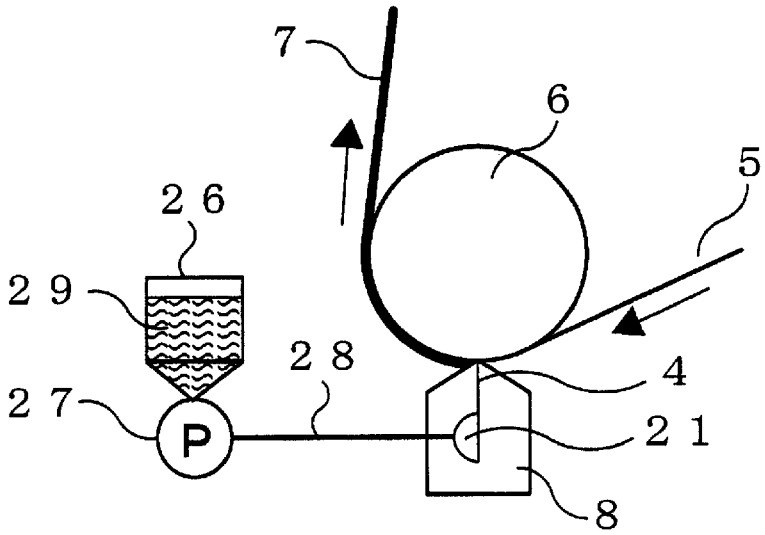
FIG. 8 shows a conceptual view of a die coating apparatus.

FIG. 8 shows a method of monolayer coating using the die 8 of the invention. With reference to this figure, the coating solution 29 stored in a tank 26 is then stored in the pocket 21 of the die 8 via a pump 27 and a supply pipe 28. Then, the coating solution 29 passes through the slit 4, and is coated onto the band-shaped support 5 continuously transported by the backup roll 6 to form a coating layer 7. The band-shaped support 5 and the coating layer 7 go through, if necessary, the necessary steps such as a drying step not shown, resulting in the objective adhesive tape, foamed sheet, or the like.

The pocket 21 formed inside the die 8 of FIG. 8 can temporarily store the coating solution 29 by feeding the coating solution 29 stored in the tank 26 through the supply pipe 28 by means of a feed control device of the coating solution placed outside the die such as a gear pump 27. The size and shape thereof may be arbitrarily set.

Figure 3:
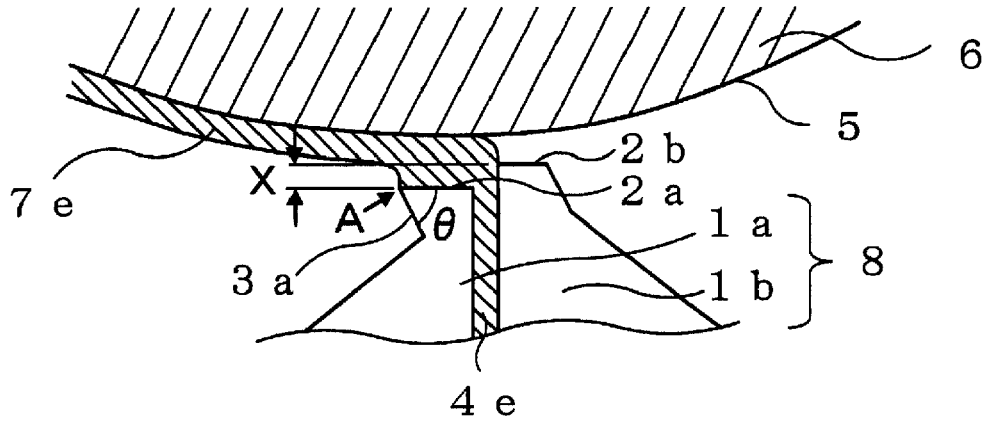
FIG. 3 shows still another shape of a tip part of a lip of a die coating apparatus proposed in the present invention.

Incidentally, as shown in FIG. 3, the die 8 for use in the monolayer coating may also be configured such that the downstream-side bar 1*a* and the upstream-side bar 1*b* face each other with an arbitrary gap therebetween along the direction of transportation of the band-shaped support 5 continuously transported by the backup roll 6 so as to form a slit 4*e*; the angle θ formed between the base 2*a* and the outer wall surface 3*a* of the lip of the downstream-side bar 1*a* is an acute angle; and the base 2*b* of the lip of the upstream-side bar 1*b* is situated at a position higher than the base 2*a* of the lip of the downstream-side bar 1*a* by the difference X in height.

In the die 8 of FIG. 3, the difference X in height is preferably 0.3 mm to 3 mm. The optimum value thereof is preferably a value resulting in 30% to 130%, and further preferably 50% to 100% relative to the coating layer thickness. Even in the case the wet layer to be coated is increased in thickness, if the base 2*a* of the lip of the downstream-side bar 1*a* is separated from the band-shaped support 5 by the distance equal to or larger than the thickness of the wet layer, since the base 2*b* of the lip of the upstream-side bar 1*b* is closer to the band-shaped support 5 than the base 2*a* of the lip of the downstream-side bar 1*a* by the difference X in height, the coating solution 7*e* is coated onto the band-shaped support 5 in such a form as to be supported by the upstream-side bar 1*b*. For this reason, fluctuations in coated surface become less likely to occur, which enables stable coating.

By carrying out coating using the die 8 having the lip shape shown in FIG. 3, the coating thickness can be set at 300 μm to 3000 μm, and further at 400 μm to 2000 μm.

Figure 2:
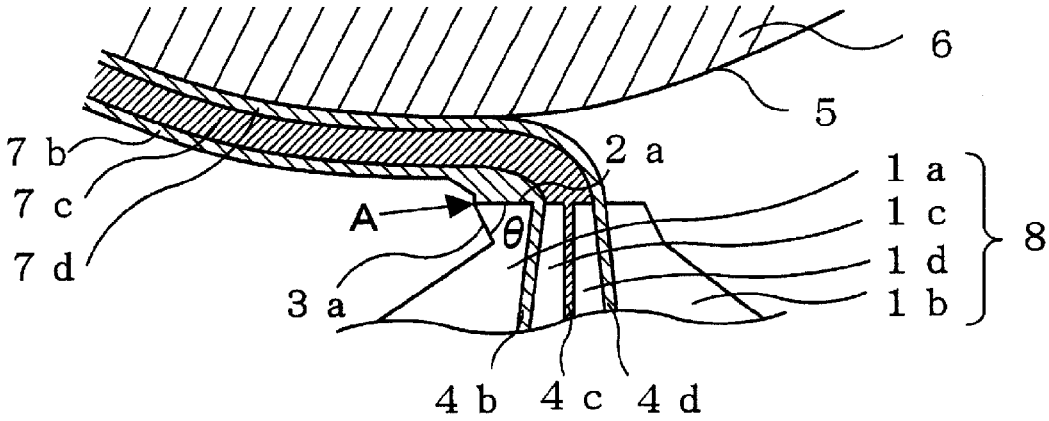
FIG. 2 shows another shape of a tip part of a lip of a die coating apparatus proposed in the present invention.

Then, FIG. 2 shows an embodiment of a cross sectional view of the tip of the die for use in the die coating apparatus and die coating method of the invention in the case of carrying out multilayer coating. As shown in FIG. 2, the die 8 is configured such that the downstream-side bar 1*a*, and the upstream-side bar 1*b*, and other first bar 1*c* and second bar 1*d* face one another with arbitrary gaps each therebetween along the direction of transportation of the band-shaped support 5 continuously transported by the backup roll 6 so as to form slits 4*b*, 4*c*, and 4*d*; and the angle θ formed between the base 2*a* and the outer wall surface 3*a* of the lip of the downstream-side bar 1*a* is an acute angle.

When coating is carried out with the die 8 having the lip shape of FIG. 2, even in the case that bars are inserted between the downstream-side bar 1*a* and the upstream-side bar 1*b* to thereby coat coating solutions 7*b*, 7*c*, and 7*d* in a multilayer, since the angle θ formed between the base 2*a* and the outer wall surface 3*a* of the lip of the downstream-side bar 1*a* is an acute angle, the coating solution 7*b* discharged from the outlet of the slit 4*b* becomes less likely to be deposited on the lip outer wall surface 3*a* beyond the tip part A of the lip. Accordingly, the occurrence of skinning due to solvent evaporation after deposition of the coating solution on the outer wall surface of the lip can be prevented and coating can thus be stably carried out without causing defects such as lateral steps or stripes on the coated surface.

Figure 9:
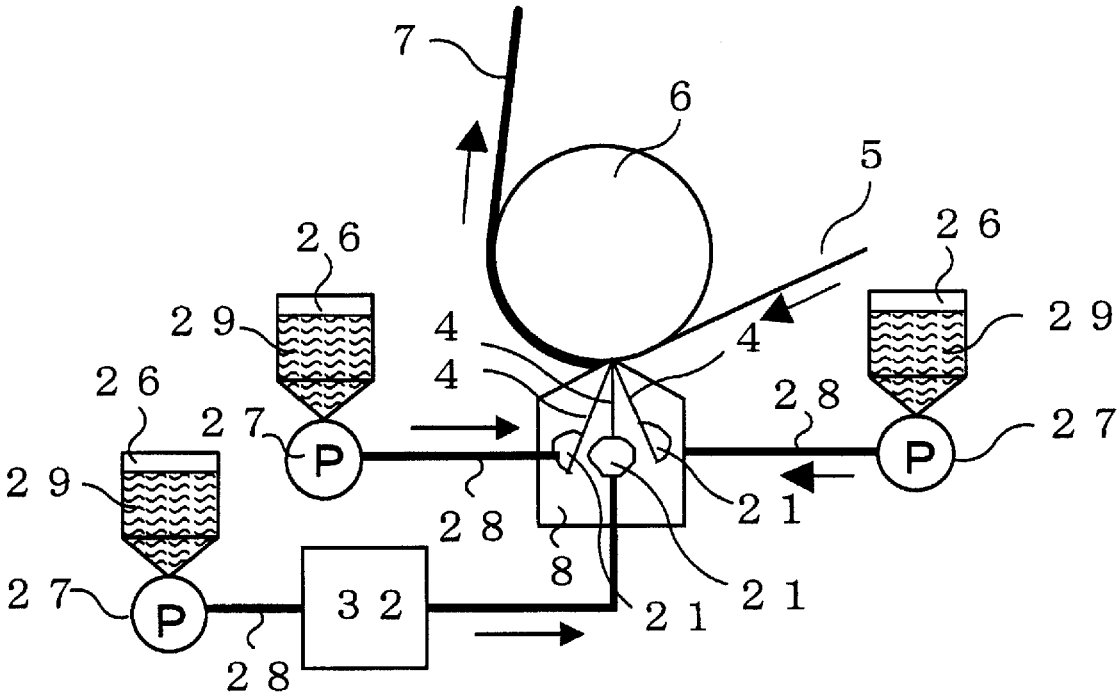
FIG. 9 shows a view showing a flow of coating solution supply of a die coating apparatus for multilayer coating.

FIG. 9 shows an embodiment of use of the die 8 when multilayer coating is carried out according to the invention. In accordance with this embodiment, the coating solutions 29 stored in respective tanks 26 are then stored in the pockets 21 of the die 8 through the pumps 27 and the supply pipes 28. Then, the respective coating solutions 29 pass through the slits 4, and are coated on the band-shaped support 5 continuously transported by the backup roll 6 to form a multilayered coating solution layer 7. The band-shaped support 5 and the multilayered coating solution layer 7 go through, if required, the necessary steps such as a drying step not shown, resulting in the objective adhesive tape, foamed sheet, or the like.

Figure 4:
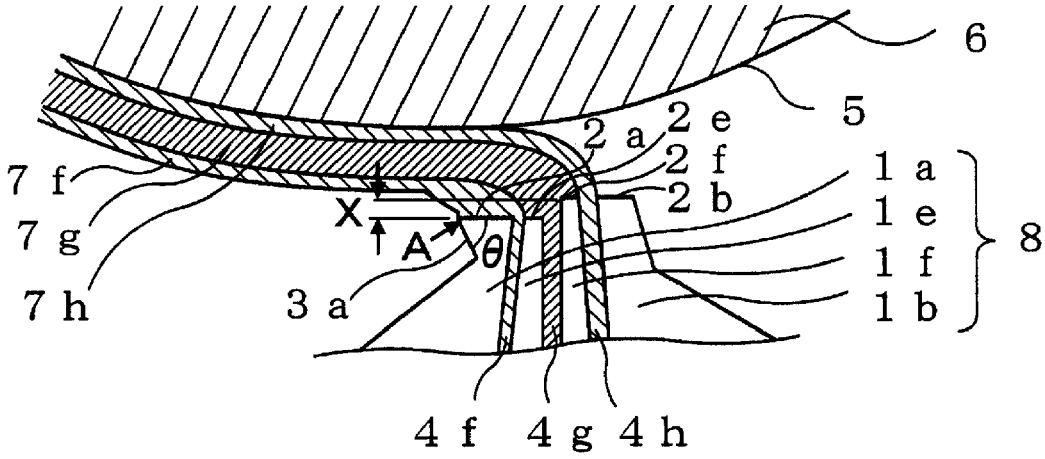
FIG. 4 shows still another shape of a tip part of a lip of a die coating apparatus proposed in the present invention.

Incidentally, as shown in FIG. 4, the die 8 for use in the multilayer coating can be configured such that the downstream-side bar 1*a*, and the upstream-side bar 1*b*, and other first bar 1*e* and second bar 1*f* face one another with arbitrary gaps each therebetween along the direction of transportation of a band-shaped support 5 continuously transported by the backup roll 6 so as to form slits 4*f*, 4*g*, and 4*h*; the angle θ formed between the base 2*a* and the outer wall surface 3*a* of the lip of the downstream-side bar 1*a* is an acute angle; and the base 2*f* of the lip of the second bar 1*f* is situated at a position higher than the base 2*e* of the lip of the first bar 1*e* by a difference X in height.

When coating is carried out with the die 8 having the lip shape of FIG. 4, in the case that bars 1*e* and 1*f* are inserted between the downstream-side bar 1*a* and the upstream-side bar 1*b* to thereby coat coating solutions 7*f*, 7*g*, and 7*h* in a multilayer and the wet layer of the intermediate layer is increased in thickness, since the base 2*f* of the lip of the second bar 1*f* can be made closer to the band-shaped support 5 than the base 2*e* of the lip of the first bar 1*e* by the difference X in height, the coating solution 7*g* for the intermediate layer is coated onto the band-shaped support 5 in such a form as to be supported by the second bar 1*f*. For this reason, even when only the intermediate layer is to be coated thick, fluctuations in coated surface become less likely to occur, which enables stable coating.

By carrying out coating using the die 8 having the lip shape shown in FIG. 4, the coating thickness of the intermediate layer can be set at 300 μm to 3000 μm, and further at 400 μm to 2000 μm.

Figure 5:
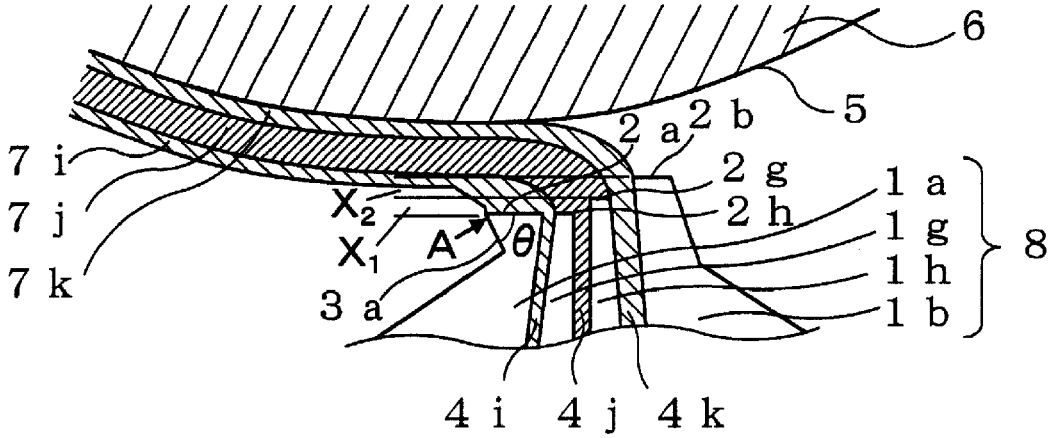
FIG. 5 shows still another shape of a tip part of a lip of a die coating apparatus proposed in the present invention.
Figure 6:
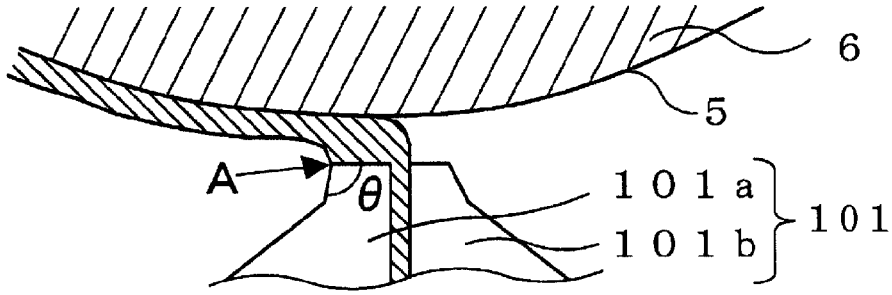
FIG. 6 shows a shape of a tip part of a lip of a conventional die coating apparatus.
Figure 7:
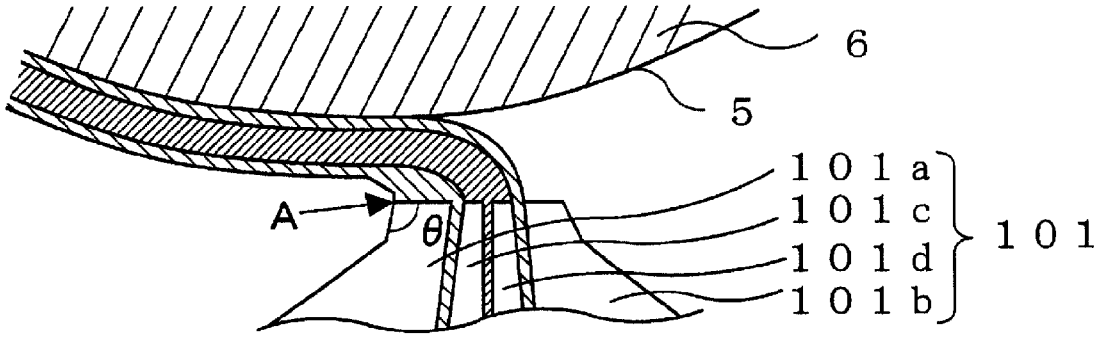
FIG. 7 shows another shape of a tip part of a lip of a conventional die coating apparatus.

Further, as shown in FIG. 5, the die 8 for use in the multilayer coating can also be configured such that the downstream-side bar 1*a*, and the upstream-side bar 1*b*, and other first bar 1*g* and second bar 1*h* face one another with arbitrary gaps each therebetween along the direction of transportation of the band-shaped support 5 continuously transported by the backup roll 6 to thereby form slits 4*i*, 4*j*, and 4*k*; the angle θ formed between the base 2*a* and the outer wall surface 3*a* of the lip of the downstream-side bar 1*a* is an acute angle; the base 2*h* of the lip of the second bar 1*h* is situated at a position higher than the base 2*g* of the lip of the first bar 1*g* by the difference X1 in height; and the base 2*b* of the lip of the upstream-side bar 1*b* is situated at a position higher than the base 2*h* of the lip of the second bar 1*h* by the difference X2 in height.

In the die 8 of FIG. 5, the differences X1 and X2 in height are respectively preferably 0.3 mm to 3 mm. Each optimum value thereof is preferably a value resulting in 30% to 130%, and further preferably 50% to 100% relative to the coating layer thickness. When coating is carried out by means of the die 8 having the lip shape of FIG. 5, even in the case that the bars 1*g* and 1*h* are inserted between the downstream-side bar 1*a* and the upstream-side bar 1*b* to thereby coat the coating solutions 7*i*, 8*j*, and 7*k* in a multilayer and the respective wet layers formed of the coating solutions 7*j* and 7*k* are increased in thickness, since the base 2*h* of the lip of the second bar 1*h* can be made closer to the band-shaped support 5 than the base 2*g* of the lip of the first bar 1*g* by the difference X1 in height as well as the base 2*b* of the lip of the upstream-side bar 1*b* can be made closer to the band-shaped support 5 than the base 2*h* of the lip of the second bar 1*h* by the difference X2 in height, the coating solutions 7*j* and 7*k* fed through the slits 4*j* and 4*k*, respectively, are coated onto the band-shaped support 5 in such a form as to be supported by the bars 1*h* and 1*b* situated upstream of respective slits 4*j* and 4*k*. Accordingly, even when a given layer is coated thick in multilayer coating, fluctuations in coated surface become less likely to occur, which enables stable coating.

By carrying out coating using the die 8 having the lip shape shown in FIG. 5, the wet thicknesses of the coating solutions 7*j* and 7*k* discharged onto the band-shaped support 5 continuously transported by the backup roll 6 can be set at 300 μm to 3000 μm, and further at 400 μm to 2000 μm.

The number of the bars to be inserted between the downstream-side bar 1*a* and the upstream-side bar 1*b* of the die 8 of FIG. 3, 4, or 5 may be arbitrarily increased according to the number of layers to be coated.

Further, the number of the tanks 26, the number of the pumps 27, the number of the supply tubes 28, the number of the pockets 21, and the number of the slits 4 of the multilayer die coating apparatus shown in FIG. 9 may also be arbitrarily changed according to the number of layers to be coated.

EXAMPLES

Below, the invention will be described by way of examples. However, the invention is not limited thereto at all.

Example 1

A coating solution 7*e* having a viscosity of about 30 Pa·s was fed out toward a PET support having a thickness of 38 μm and continuously transported by a backup roll so as to achieve a coating layer thickness of 100 μm using a die having the lip tip part shape of FIG. 3 proposed in the invention for the die coating apparatus shown in FIG. 8. Thus, a coating experiment was carried out. At this time, as the shape of the lip tip part of the die used, the difference X in level between the upstream-side bar 1*b* and the downstream-side bar 1*a* sandwiching the slit 4*e* for feeding out the coating solution 7*e* therethrough was set at 0 mm, and the inclination angle θ of the side end part of the lip of the downstream-side bar 1*a* was set at 20°. Table 1 shows the results of observation of the conditions of the coated surface when the transportation speed of the band-shaped support was changed to 4 m/min, 7 m/min, and 10 m/min.

Example 2

Coating was carried out under the same conditions as those in Example 1, except that the inclination angle θ of Example 1 was set at 45°. Table 1 shows the results of observation of the conditions of the coated surface.

Example 3

Coating was carried out under the same conditions as those in Example 1, except that the inclination angle θ of Example 1 was set at 80°. The results are shown in Table 1.

Example 4

Coating was carried out under the same conditions as those in Example 3, except that the difference X in level of Example 3 was set at 0.1 mm, and that the coating layer thickness was set at 600 μm. Table 1 shows the results of observation of the conditions of the coated surface.

Example 5

Coating was carried out under the same conditions as those in Example 3, except that the difference X in level of Example 3 was set at 0.3 mm, and that the coating layer thickness was set at 600 μm. Table 1 shows the results of observation of the conditions of the coated surface.

Example 6

Coating was carried out under the same conditions as those in Example 3, except that the difference X in level of Example 3 was set at 3 mm, and that the coating layer thickness was set at 3000 μm. Table 1 shows the results of observation of the conditions of the coated surface.

Example 7

Coating solutions 7*h*, 7*g*, and 7*f* having a viscosity of about 30 Pa·s were fed out toward a PET support having a thickness of 38 μm and continuously transported by a backup roll so that respective coating layer thicknesses of the coating solutions fed through the slits 4*h*, 4*g*, and 4*f* were sequentially 50 μm, 800 μm, and 50 μm, respectively, using a die having the lip tip part shape of FIG. 4 proposed in the invention for the die coating apparatus shown in FIG. 9. Thus, a coating experiment was carried out. At this time, as the shape of the lip tip part of the die used, the difference X in level between the bar 1*f* and the bar 1*e* sandwiching the slit 4*g* for feeding out the coating solution 7*g* therethrough was set at 0 mm, and the inclination angle θ of the side end part of the lip of the downstream-side bar 1*a* was set at 20°. Table 1 shows the results of observation of the conditions of the coated surface when the transportation speed of the band-shaped support was changed to 4 m/min, 7 m/min, and 10 m/min. Incidentally, the layer thickness refers to the wet layer thickness of the coating solution 7*g* fed out through the slit 4*g*.

Example 8

Coating was carried out under the same conditions as those in Example 7, except that the difference X in level of Example 7 was set at 1 mm. The results are shown in Table 1.

Example 9

Coating was carried out under the same conditions as those in Example 7, except that the difference X in level of Example 7 was set at 0.4 mm, and that respective coating layer thicknesses of the coating solutions fed out through the slits 4*h*, 4*g*, and 4*f* were sequentially 50 μm, 300 μm, and 50 μm, respectively. The results are shown in Table 1.

Example 10

Coating was carried out under the same conditions as those in Example 7, except that the difference X in level of Example 7 was set at 3 mm, and that respective coating layer thicknesses of the coating solutions fed out through the slits 4*h*, 4*g*, and 4*f* were sequentially 50 μm, 3000 μm, and 50 μm, respectively. The results are shown in Table 1.

Comparative Example 1

Coating was carried out under the same conditions as those in Example 1, except that the inclination angle θ of Example 1 was set at 10°. The results are shown in Table 1.

Comparative Example 2

Coating was carried out under the same conditions as those in Example 1, except that the inclination angle θ of Example 1 was set at 110°. The results are shown in Table 1.

Comparative Example 3

Coating was carried out under the same conditions as those in Example 6, except that the difference X in level of Example 6 was set at 4 mm. The results are shown in Table 1.

Comparative Example 4

Coating was carried out under the same conditions as those in Example 7, except that the inclination angle θ of Example 7 was set at 110°. The results are shown in Table 1.

Conditions of Coated Surface

As for the conditions of the coated surface after coating of the coating solution, a sample in which coating stripes occurred is referred to as "stripes"; a sample in which no coating stripes occurred is referred to as "favorable"; and a sample in which bubbles were included in the coating solution is referred to as "air inclusion".

Evaluation

As the comprehensive evaluation thereof, a sample which showed "favorable" coated surface conditions when the transportation speed of the band-shaped support was 4 m/min is referred to as "Good"; a sample which showed "favorable" coated surface conditions even in all the cases where the transportation speed was changed to 4 m/min, 7 m/min, and 10 m/min is particularly referred to as "Very Good"; and a sample in which "stripes" or "air inclusion" occurred on the coated surface when the transportation speed of the band-shaped support was 4 m/min is referred to as "Poor".

TABLE 1

| | Number of layers | Inclination angle θ | Difference X in level | Layer thickness | Coated surface conditions | | | |
|---|---|---|---|---|---|---|---|---|
| | [—] | [°] | [mm] | [μm] | 4 m/min | 7 m/min | 10 m/min | Evaluation |
| Ex. 1 | 1 | 20 | 0 | 100 | Favorable | Stripes | Stripes | Good |
| Ex. 2 | 1 | 45 | 0 | 100 | Favorable | Favorable | Stripes | Good |
| Ex. 3 | 1 | 80 | 0 | 100 | Favorable | Favorable | Stripes | Good |
| Ex. 4 | 1 | 80 | 0.1 | 600 | Favorable | Favorable | Stripes | Good |
| Ex. 5 | 1 | 80 | 0.3 | 600 | Favorable | Favorable | Favorable | Very Good |
| Ex. 6 | 1 | 80 | 3 | 3000 | Favorable | Favorable | Favorable | Very Good |
| Ex. 7 | 3 | 80 | 0 | 800 | Favorable | Favorable | Stripes | Good |
| Ex. 8 | 3 | 80 | 1 | 800 | Favorable | Favorable | Favorable | Very Good |
| Ex. 9 | 3 | 80 | 0.4 | 300 | Favorable | Favorable | Favorable | Very Good |
| Ex. 10 | 3 | 80 | 3 | 3000 | Favorable | Favorable | Favorable | Very Good |

TABLE 1-continued

| | Number of layers | Inclination angle θ | Difference X in level | Layer thickness | Coated surface conditions | | | |
|---|---|---|---|---|---|---|---|---|
| | [—] | [°] | [mm] | [μm] | 4 m/min | 7 m/min | 10 m/min | Evaluation |
| Com. Ex. 1 | 1 | 10 | 0 | 100 | Stripes | Stripes | Stripes | Poor |
| Com. Ex. 2 | 1 | 110 | 0 | 100 | Stripes | Stripes | Stripes | Poor |
| Com. Ex. 3 | 1 | 80 | 4 | 3000 | Air inclusion | Air inclusion | Air inclusion | Poor |
| Com. Ex. 4 | 3 | 110 | 0 | 800 | Stripes | Stripes | Stripes | Poor |

While the present invention has been described in detail and with reference to specific embodiments thereof, it will be apparent to one skilled in the art that various changes and modifications can be made therein without departing from the scope thereof.

This application is based on Japanese patent application No. 2008-110111 filed on Apr. 21, 2008, the entire contents thereof being hereby incorporated by reference.

Further, all references cited herein are incorporated in their entireties.

What is claimed is:

1. A die coating apparatus, which comprises a die comprising an upstream-side bar and a downstream side-bar aligned with each other along a direction of transportation of a band-shaped support continuously transported by a backup roll so as to form a pocket for storing a coating solution and a slit serving as a feed-out path of the coating solution, said slit having an outlet for feeding out the coating solution stored in the pocket of the die therefrom to thereby coat the coating solution on the band-shaped support, wherein the downstream-side bar has a lip having a divergent cross-sectional shape continuous in the direction of a width of the downstream-side bar, and an inclination angle θ of a side end part on the most downstream side of the lip of the downstream-side bar is within the range of 20° to 80° and wherein a height of the tip part of a lip of the upstream-side bar is larger than a height of a tip part of the lip of the downstream-side bar by 0.3 mm to 3 mm.

2. The die coating apparatus according to claim 1, which further comprises another one or more bars sandwiched between the upstream-side bar and the downstream-side bar of the die so as to form two or more pockets for storing two or more kinds of coating solutions and two or more slits serving as feed-out paths of the two or more kinds of the coating solutions, whereby a multilayered wet layer of the coating solutions is formed on the band-shaped support.

3. The die coating apparatus according to claim 2, wherein a height of a tip part of a lip of the upstream-side bar is larger than a height of a tip part of the lip of the downstream-side bar by 0.3 mm to 3 mm.

4. The die coating apparatus according to claim 3, wherein at least one layer of the multilayered wet layer coated on the band-shaped support has a thickness of 300 μm to 3000 μm.

5. A die coating method, which comprises feeding out a coating solution stored in a pocket of a die in which an upstream-side bar and a downstream-side bar are aligned with each other along a direction of transportation of a band-shaped support continuously transported by a backup roll so as to form the pocket for storing the coating solution and a slit serving as a feed-out path of the coating solution, from an outlet of the slit to thereby coat the coating solution on the band-shaped support, wherein the downstream-side bar has a lip having a divergent cross-sectional shape continuous in the direction of a width of the downstream-side bar, and an inclination angle θ of a side end part on the most downstream side of the lip of the downstream-side bar is within the range of 20° to 80° and wherein a height of the tip part of a lip of the upstream-side bar is larger than a height of a tip part of the lip of the downstream-side bar by 0.3 mm to 3 mm.

6. The die coating method according to claim 5, wherein another one or more bars are sandwiched between the upstream-side bar and the downstream-side bar of the die so as to form two or more pockets for storing two or more kinds of coating solutions and two or more slits serving as feed-out paths of the two or more kinds of coating solutions, whereby a multilayered wet layer of the coating solutions is formed on the band-shaped support.

7. The die coating method according to claim 6, wherein a height of a tip part of a lip of the upstream-side bar is larger than a height of a tip part of the lip of the downstream-side bar by 0.3 mm to 3 mm.

8. The die coating method according to claim 7, wherein at least one layer of the multilayered wet layer coated on the band-shaped support has a thickness of 300 μm to 3000 μm.

9. An adhesive sheet, which is manufactured by the die coating method according to claim 5.

10. A foamed sheet containing bubbles, which is manufactured by the die coating method according to claim 5.

* * * * *